US005421797A

United States Patent [19]

Fletcher

[11] Patent Number: 5,421,797

[45] Date of Patent: Jun. 6, 1995

[54] COMBINATION WEIGHT PLATE AND DUMBBELL AND BAR FOR USE WITH THE SAME

[76] Inventor: Michael G. Fletcher, 8427 Burwood Park Dr., Spring, Tex. 77379

[21] Appl. No.: 153,295

[22] Filed: Nov. 16, 1993

[51] Int. Cl.[6] ..... A63B 21/072

[52] U.S. Cl. ..... 482/106; 482/107; 482/108

[58] Field of Search ..... 482/93, 106–110, 482/94, 97

[56] References Cited

U.S. PATENT DOCUMENTS

| | | | |
|---|---|---|---|
| D. 274,283 | 6/1984 | Wright | 482/108 X |
| 1,630,467 | 5/1927 | Bradstreet | 482/108 X |
| 3,022,073 | 2/1962 | Miller | 482/106 |
| 3,617,056 | 11/1971 | Herbold | 482/108 |
| 4,029,312 | 6/1977 | Wright | 482/108 |
| 4,515,364 | 5/1985 | Botella | 482/93 X |
| 4,575,074 | 3/1986 | Damratoski | 482/93 |
| 4,618,142 | 10/1986 | Joseph, Jr. | 482/110 X |
| 4,743,017 | 5/1988 | Jaeger | 482/108 |
| 4,854,575 | 8/1989 | Wilson et al. | 482/108 |
| 4,863,158 | 9/1989 | Tassone | 482/106 X |
| 4,997,184 | 3/1991 | Sherman | 482/108 |
| 5,137,502 | 8/1992 | Anastasi | 482/108 X |
| 5,184,993 | 2/1993 | Dowdeswell | 482/106 |

FOREIGN PATENT DOCUMENTS

| | | | |
|---|---|---|---|
| 524174 | 8/1921 | France | 482/108 |

*Primary Examiner*—Richard J. Apley
*Assistant Examiner*—John Mulcahy
*Attorney, Agent, or Firm*—Arnold, White & Durkee

[57] ABSTRACT

A combination weight plate/dumbbell may be used alone as a dumbbell or in numbers on a barbell. The weight plate dumbbell is plate-like in appearance, but it is smaller in diameter and thicker than a traditional weight plate of similar weight. The weight plate/dumbbell includes a central aperture having a handle extending across it. The handle is thinner in diameter than the thickness of the plate and the aperture is sized so that a person can grasp the handle and pick up the weight even if it is lying flat on the floor. A barbell having slotted collars can accept the weight plate/dumbbells for barbell-type exercises.

5 Claims, 3 Drawing Sheets

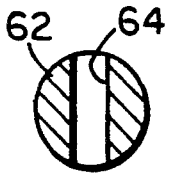
Fig. 11A
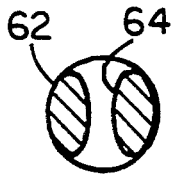
Fig. 11B
Fig. 12
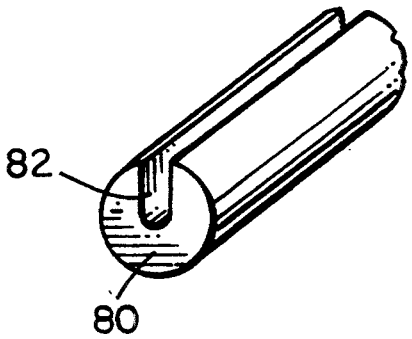
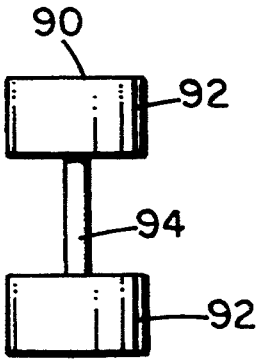
Fig. 13
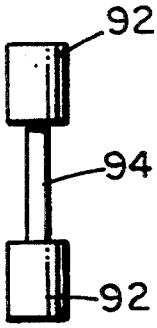
Fig. 14
Fig. 15
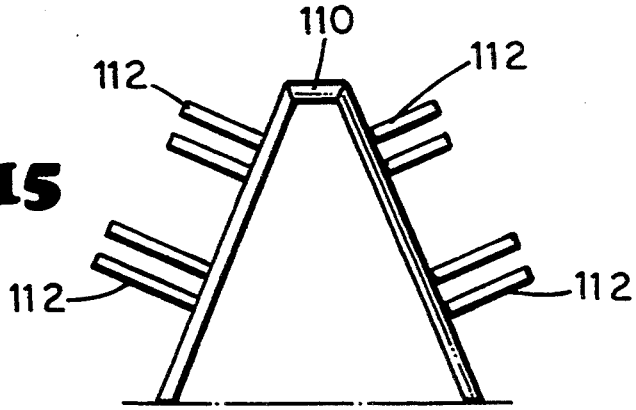

COMBINATION WEIGHT PLATE AND DUMBBELL AND BAR FOR USE WITH THE SAME

BACKGROUND OF THE INVENTION

1. Field Of The Invention

The present invention relates generally to weight training devices and, more particularly, to a weightlifting device that may be used individually as a dumbbell or in combination with other similar devices on a barbell.

2. Description Of The Related Art

In the past decade, people have become more health conscious. This health consciousness has prompted people to drastically alter their lifestyles. For instance, people are exercising more and continuing to exercise into their later years.

As a result of this trend, sporting goods, and particularly sporting goods relating to more rigorotis activities, have experienced a tremendous upswing in demand. Health clubs and sporting facilities are springing up at an ever increasing rate. Golf courses, softball clubs, gymnasiums, aerobic studios, and bodybuilding gyms are but a few examples.

With respect to weight training, not only are people flocking to health clubs that include weight training facilities, but they are also purchasing weight training devices for use in their homes. A full service health club may include exercise bikes, stair climbers, weight machines, and, of course, free weights, and many of the devices found in a full service health club are also available to consumers for home use.

Regardless of where these devices are used, space is always at a premium and purchasers wish to get the most versatile weight device for their money. While great strides have been made in the area of weight training machines, free weights have improved little over the years. Free weights typically include a 45 pound barbell with olympic sized collars, disc-like weight plates having standardized weights (such as 2½, 5, 10, 25, 35 and 45 pounds), and assorted dumbbells. Free weights, with the help of specialized benches and simple mechanical devices, can be used to develop virtually every muscle in the body. Although barbells may be useful for some of these development exercises, dumbbells are preferred for others. Therefore, when a health club or home user purchases tree weights, they must typically purchase barbell sets which include the bars and disc-like weight plates that slide onto them, as well as a variety of dumbbells. Typically, dumbbell type exercises cannot be performed with the weight plates, and, often, barbell type exercises cannot be performed with dumbbells. Therefore, consumers are faced with the prospect of purchasing a complete barbell set and a complete dumbbell set in order to have an adequate free weight training facility.

The present invention is directed to overcoming, or at least reducing the effects, one or more of the problems set forth above.

SUMMARY OF THE INVENTION

In accordance with one aspect of the present invention, there is provided a plate-like member that has a first side and a second side, an aperture that extends from the first side to the second side, and a handle that extends across the aperture. The member may be used alone as a dumbbell or in combination with other members on a barbell.

BRIEF DESCRIPTION OF THE DRAWINGS

The foregoing and other advantages of the invention will become apparent upon reading the following detailed description and upon reference to the drawings in which:

FIG. 11A illustrates a cross-sectional view of the collar in FIG. 10 taken along line 11—11;

FIG. 11B illustrates an alternative cross-sectional view of the collar in FIG. 10 taken along line 11—11;

FIG. 12 illustrates an alternative embodiment of a collar for a barbell in accordance with the present invention;

FIG. 13 illustrates another alternative combination weight plate/dumbbell in accordance with the present invention;

FIG. 14 illustrates a side view of the weight plate/dumbbell in FIG. 13; and FIG. 15 illustrates a weight tree having collars adapted to accept a weight plate/dumbbell combination in accordance with the present invention.

Figure 1:
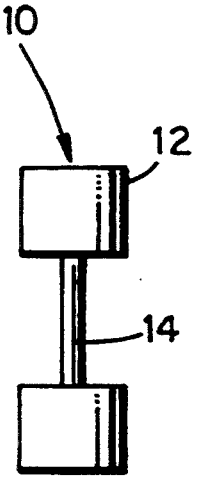
Fig. 1 ( PRIOR ART )
FIG. 1 illustrates a prior art dumbbell.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives following within the spirit and scope of the invention as defined by the appended claims.

DESCRIPTION OF THE PREFERRED EMBODIMENTS

Turning now to the drawings and referring initially to the prior art, it should be noticed that dumbbells, such as the dumbbell 10 illustrated in FIG. 1, are typically designed to have two relatively symmetrical weights 12 connected by a handle 14. A typical 45 pound dumbbell 10 is about 14 inches long, and each weight is about 5 inches to 6 inches in diameter. The dumbbell 10 is particularly suited to one-arm exercises. A person can easily grasp the handle 14, and the weights generally are not large enough to unduly interfere with the person's body while lifting. However, the dumbbell 10 clearly cannot be used to perform barbell-type exercises, because it cannot be conveniently attached to a barbell.

Figure 2:
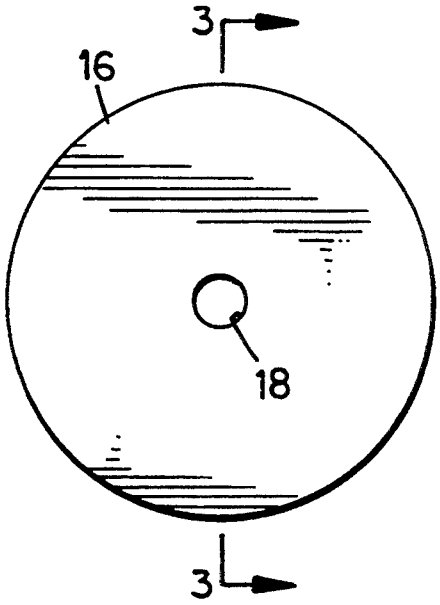
Fig. 2 ( PRIOR ART )
FIG. 2 illustrates a prior art disc-like plate.
Figure 3:
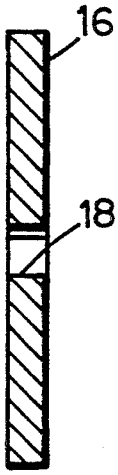
Fig. 3 ( PRIOR ART )
FIG. 3 illustrates a side view of the plate in FIG. 2 taken along line 3—3.

In contrast to a dumbbell, a typical weight plate, such as the weight plate 16 illustrated in FIGS. 2 and 3, includes a circular aperture 18 that allows the plate 16 to be placed over a circular end member, or collar, on a barbell. A typical 45 pound weight plate is about 20 inches in diameter and about one inch wide. Each side of the plate 16 is substantially fiat, although a peripheral ridge and raised indicia, such as the manufacturer's name and the weight of the plate, often appear on at least one side of traditional plates 16. As can be seen, the diameter of the weight plate 16 is much greater that the width or thickness of the weight plate 16. This construction is advantageous since a person may need to place a number of weight plates 16 adjacent one another on the collar of a barbell to construct a barbell of the desired weight. However, because a typical weight plate 16 is difficult to grasp in one hand, it generally cannot be used to perform dumbbell-type exercises.

Figure 4:
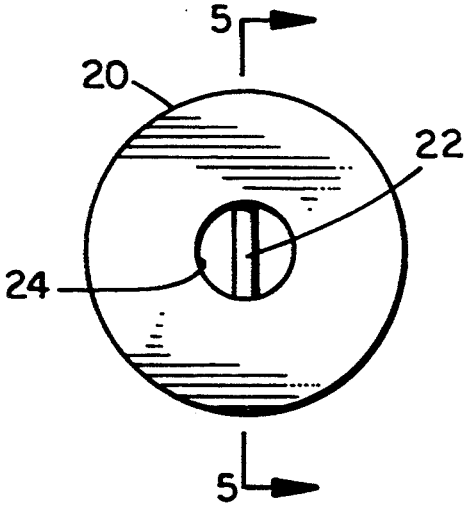
FIG. 4 illustrates a combination weight plate/dumbbell in accordance with the present invention.

A weight plate that is adapted for use on a barbell and that can also be used for dumbbell-type exercises overcomes these problems. Of course, like the traditional weights mentioned above, the combination weight plate/dumbbells described herein are preferably made in a conventional manner from iron or steel. FIG. 4 illustrates such a combination weight plate/dumbbell 20. The weight plate/dumbbell 20 retains a plate-like shape so that it can be used efficiently on a barbell. The illustrated weight plate/dumbbell 20 is approximately scaled to the prior art weight plate 16 of FIGS. 2 and 3. It should be noticed that the 45 pound weight plate/-dumbbell 20 is smaller in diameter and thicker than the prior art weight plate 16. However, the thickness of the weight plate/dumbbell 20 is not too much greater than its predecessor 16, thus enabling a number of weight plate dumbbells 20 to be placed adjacent one another on the collars of a barbell, such as the barbell illustrated in FIG. 10.

Figure 5:
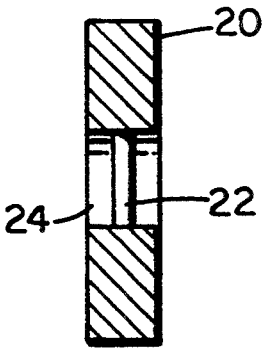
FIG. 5 illustrates a cross-sectional view of the weight plate/dumbbell in FIG. 1 taken along line 5—5.

To allow the weight plate/dumbbell 20 to be used as a dumbbell, it includes a handle 22 that extends across an aperture 24 in the center thereof. Preferably, the handle 22 is approximately one inch in diameter, and the aperture 24 is sized to allow one's hand to grasp the handle 22, e.g., the aperture 24 is about five to six inches in diameter. As illustrated in FIGS. 4 and 5, the handle 22 is preferably disposed centrally within the aperture 24 and spaced apart from either side of the weight plate/dumbbell 20 so that it is balanced. It should also be noticed that the weight plate/dumbbell 20 is thinner than the weights 12 of the dumbbell 10, yet thicker than the predecessor plate 16. Preferably, the weight plate/-dumbbell 20 is about three to four inches thick. Given the thickness of the weight plate/dumbbell 20 and the central location of the handle 22, a person can grasp the handle 22 and pick up the weight plate/dumbbell 20 even if it is lying flat on the ground.

Figure 6:
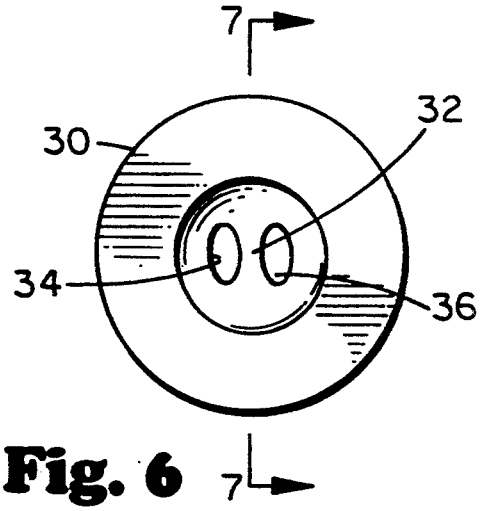
FIG. 6 illustrates a weight plate/dumbbell combination having an alternative handle configuration in accordance with the present invention.
Figure 7:
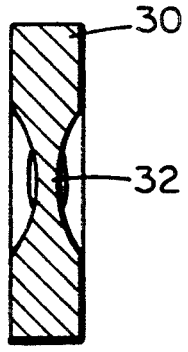
FIG. 7 illustrates a cross-sectional view of the weight plate/dumbbell in FIG. 6 taken along line 7—7.

For greater user comfort during dumbbell-type exercises, FIG. 6 illustrates a combination weight plate/-dumbbell 30 that has an alternative handle configuration. The weight plate/dumbbell 30 includes a handle 32 that is formed by making smooth apertures 34 and 36 proximate the center of the plate 30. As illustrated in FIG. 7, the handle 32 is formed using smooth contours with the remainder of the weight plate/dumbbell 30 to provide fewer angled edges.

Figure 8:
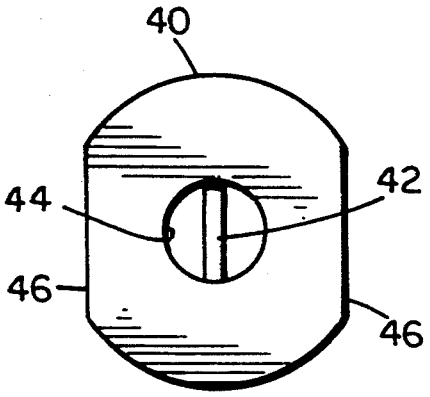
FIG. 8 illustrates a weight plate/dumbbell combination having flattened edges in accordance with the present invention.

Anyone who has used a barbell in a lift that begins with the barbell resting on the floor knows that the barbell may roll out of position. FIG. 8 illustrates another embodiment of a combination weight plate/-dumbbell 40 that overcomes this problem. It has a handle 42 disposed within a central aperture 44 much the same as the weight plate/dumbbell 20 illustrated previously. However, the weight plate/dumbbell 40 includes two flattened edges 46. When the weight plate/dumbbell 40 is attached to either side of a barbell, such as that illustrated in FIG. 10, the flattened edges 46 do not greatly reduce the ability of the barbell to roll if the user desires to position it elsewhere on the floor, but it does provide sufficient resistance to rolling once the user places the barbell with one of the flat edges 46 in contact with the ground to prevent the barbell from rolling out of position. Since barbells often roll when the user does not desire them to roll, and since each weight plate/dumbbell 40 preferably includes the same angular relationship between the flat edges 46 and the handle 42, the weight plate/dumbbell 40 may be used on a barbell to solve this problem. As an additional benefit, the weight plate/dumbbell 40 exhibits an oblong shape similar to that of the traditional dumbbell 10 so that it is even more unobtrusive to a lifter performing a dumbbell-type exercise.

Figure 9:
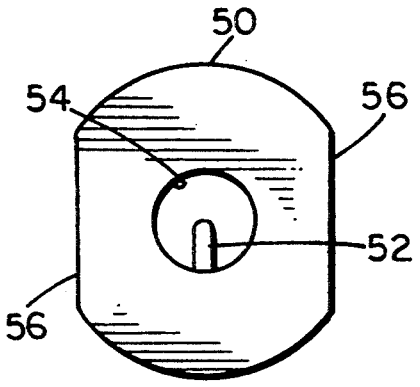
FIG. 9 illustrates a weight plate having flattened edges and having a protruding key or handle in a central aperture thereof in accordance with the present invention.

FIG. 9 illustrates an another alternative embodiment of the combination weight plate/dumbbell 40. The illustrated weight plate/dumbbell 50 includes a key or handle 52 that extends inwardly into a central aperture 54. The weight plate/dumbbell 50 further includes flattened edges 56, similar to the fiat edges 46 of the weight plate/dumbbell 40. The key or handle 52 may be just long enough to slide into a key way that is formed on the collar of a barbell, such as the collar illustrated in FIG. 12. So keyed, the flat edges 56 of each weight plate/dumbbell are be positioned in the same manner to achieve the same result as in the weight plate/dumbbell 40. Furthermore, the key or handle 52 may be extended so that it not only serves as a key but also as a handle to allow the weight plate/dumbbell 50 to be used as a dumbbell in addition to being used as a weight plate that resists rolling.

Figure 10:
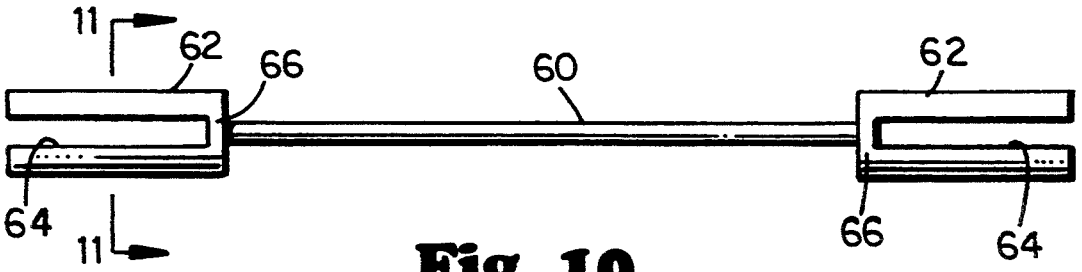
FIG. 10 illustrates a barbell bar having collars shaped to accept a weight plate/dumbbell combination in accordance with the present invention.

As previously mentioned, FIG. 10 illustrates a barbell 60 having collars 62 attached to the ends thereof. As illustrated in FIGS. 11A and 11B, the collars 62 have a slot 64 therein which corresponds to the apertures in the weight plate/dumbbells 20, 30, or 40. The base 66 of each collar 62 is preferably rigidly attached to the end of the barbell 60. This rigid attachment is preferably accomplished by welding or possibly by drop forging the collar 62 along with the barbell 60. However, it may also be desirable to have a collar that may be easily detached from the barbell 60. Therefore, the collar 62 could have an extended base portion that contains a cylindrical opening therein. The cylindrical opening may be coupled to the end of the barbell 60 and fixedly attached to the end using a set screw or any other appropriate means. Additionally, the weight plate dumbbells 20, 30, and 40 may be secured to the collars 62 by traditional cylindrical collar attachments or by D-shaped or I-shaped attachments (not shown).

The collar 80 illustrated in FIG. 12 corresponds to the weight plate/dumbbell combination 50. The collar 80 includes a slot 82. The depth of the slot 82 need not correspond to the length of the key or handle 52 if it is being used merely for keying the weight plate/dumbbell 50. Since the slot 82 does not extend all the way through the collar 80, the collar 80 exhibits more structural rigidity than the collar 62. Therefore, the slot 82 is preferably deep enough to provide sufficient structural rigidity and to accept a key or handle 52.

FIGS. 13 and 14 illustrate an alternative combination weight plate/dumbbell 90. The weight plate/dumbbell 90 more closely resembles the traditional dumbbell 10. However, it should be noticed that the end portions 92, which are connected by a handle 94, are more rectangular in shape than the regularly shaped end portions 12. Preferably, the thickness of each end portion 92 is about three to four inches like the previously described weight plate/dumbbells 20, 30, 40, and 50 that completely surround their respective handles. Shaped in this manner, the weight plate/dumbbell 90 may be used with a barbell 60 having a collar, such as the collar 62. It should also be noticed that the collar 62 need not be cylindrical in shape but may be square or rectangular in shape if it were only going to be used with the weight plate/dumbbell 90.

FIG. 15 illustrates a weight tree 110 having several collars 112 attached thereto. These collars are shaped much like the collar 62 so that they correspond with the weight plate/dumbbell being stored thereon.

I claim:

1. A barbell apparatus comprising:

a bar having a first end and a second end;

a respective collar coupled to each of said first and second ends, each collar having a slot extending longitudinally along a given length thereof; and at least two metal discs, each disc having a first side and a second side, having a first thickness between said first side and said second side, and having an aperture extending from said first side to said second side, and each disc having a handle having a second thickness being less than said first thickness, said handle being coupled to said disc within said aperture between said first side and said second side and said handle extending across said aperture, said aperture being sized to permit said disc to slide onto one of said collars with said handle disposed within said respective slot.

2. The barbell apparatus, as set forth in claim 1, wherein said at least two metal discs are made of a metal selected from the group consisting of iron and steel.

3. The barbell apparatus, as set forth in claim 1, wherein each of said discs comprises at least one flat peripheral edge.

4. The barbell apparatus, as set forth in claim 3, wherein each of said discs comprises a first flat peripheral edge and a second flat peripheral edge, said first edge being disposed opposite said second edge and being generally parallel thereto.

5. The barbell apparatus, as set forth in claim 4, wherein said first edge and said second edge of each disc are disposed generally parallel to said respective handle.

* * * * *